United States Patent [19]

Glaze, Jr.

[11] Patent Number: 4,524,889

[45] Date of Patent: Jun. 25, 1985

[54] HOSIERY PROCESSING METHOD

[75] Inventor: John W. Glaze, Jr., Charlotte, N.C.

[73] Assignee: Intech Corporation, Charlotte, N.C.

[21] Appl. No.: 489,313

[22] Filed: Apr. 28, 1983

[51] Int. Cl.[3] ..... D06C 5/00

[52] U.S. Cl. ..... 223/76; 38/1 B; 38/144; 223/112

[58] Field of Search ..... 223/51, 60, 75, 76, 223/112; 38/1 B, 144

[56] References Cited

U.S. PATENT DOCUMENTS

| | | | |
|---|---|---|---|
| 1,177,571 | 3/1916 | Palmer | 38/15 |
| 1,682,903 | 9/1928 | Hadaway, Jr. | 38/16 |
| 1,777,705 | 10/1930 | Stetten | 223/60 |
| 1,840,814 | 1/1932 | Hunt | 223/60 |
| 2,243,997 | 6/1941 | Berger et al. | 223/76 |
| 2,574,970 | 11/1951 | Heldmaier | 223/76 |
| 2,811,032 | 10/1957 | Bellmann | 68/5 |
| 2,856,108 | 10/1958 | Richter | 223/76 |
| 2,874,884 | 2/1959 | Heliot | 223/76 |
| 3,054,542 | 9/1962 | Glaze, Jr. et al. | 223/112 |
| 3,142,423 | 7/1964 | Carter | 223/76 |
| 3,451,600 | 6/1969 | Carruthers | 223/76 |
| 3,704,565 | 12/1972 | Glaze, Jr. | 223/75 X |
| 3,902,300 | 9/1975 | Glaze, Jr. | 223/37 X |

OTHER PUBLICATIONS

*Heliot* Advertisement on "Sockpress".

*Autoboard* Advertisement on "Model N72 Preboarding Machine".

*Textile Asia*, pp. 148–149 of Aug. 1979 issue; pp. 51, 52, Jul. 1980.

*Intech* Advertisement on "Hosiery Processor with Fold & Pack Unit".

*Primary Examiner*—Louis K. Rimrodt

*Attorney, Agent, or Firm*—Banner, Birch, McKie & Beckett

[57] ABSTRACT

A hosiery processing method and apparatus are disclosed. The apparatus includes a support frame; a plurality of hosiery carrying forms; an endless drive chain having a mechanism for carrying the forms; a drive for continuously driving the chain; and a flat steam chamber including a stationary first wall member and a movable second wall member. The steam chamber has a flat configuration such that the distance between the interior major surfaces of the chamber is only slightly greater than the thickness of the forms. The movable wall member is support for horizontal motion toward and away from the stationary wall member in order to open and close the flat steam chamber. A latch mechanism selectively holds the second wall member in the closed position. A holding and advancing mechanism holds a section of the drive chain temporarily stationary at the flat steam chamber and advances the section of the drive chain after it has been temporarily held stationary.

19 Claims, 14 Drawing Figures

HOSIERY PROCESSING METHOD

TECHNICAL FIELD

The present invention is directed to a method and apparatus for steam treating articles of apparel. In particular, the present invention is directed to a flat steam chamber for processing hosiery being carried on forms at high pressure, and a drive mechanism which holds the forms stationary in the chamber while the remaining portion of a driven chain carrying the forms continues in motion.

BACKGROUND OF THE INVENTION

Articles of apparel have been treated with steam for numerous purposes. In the processing of hosiery, one treatment process is preboarding. In preboarding of hosiery, the hosiery is carried on flat forms and subjected to high pressure steam for a period of time in order to set the synthetic fibers making up the hosiery. One type of steam chamber used in preboarding processes is a large cylindrical chamber wherein a large number of forms, for example, twelve double legs forms, are supported on a carriage with their major surfaces facing one another. Such a steam chamber has a relatively large internal volume; for example, 18.5 cubic feet, so that setting times are relatively long; for examle, 23 to 25 seconds at 18 to 20 psi. Low pressure steam treatment is another prior art process used generally with a natural fibers. A flat pressure chamber for use in low pressure steam treatment has recently come into commercial use.

In addition to commercial prior art uses, numerous steam treatment chambers are disclosed in the patent literature. For example, U.S. Pat. No. 2,243,997 issued to Berger, et al., on June 3, 1941, and U.S. Pat. No. 2,811,032 issued to Bellmann on Oct. 29, 1957, disclose textile steam treatment chambers wherein hosiery carried on forms are batch treated within relatively large volume chambers. In both the patents, the forms are collapsed upon one another so that the major surfaces of the forms face one another, and movable doors permit movement into and out of the chamber. The apparatus of the '997 patent is capable of relatively high pressure processing, for example, at 25 psi.

Relatively long and wide steam processing chambers are disclosed in U.S. Pat. No. 2,574,970 issued to Heldmaier on Nov. 13, 1951, and U.S. Pat. No. 2,856,108 issued to Richter on Oct. 14, 1958. In the '108 patent, a plurality of forms are carried on support carriages. A pair of support carriages enter and exit the chamber through doors at the longitudinal ends of the chamber. In the '970 patent, forms carrying hosiery continuously pass through the chamber by means of gap adjusting plates or rollers at either longitudinal end of the chamber.

SUMMARY OF THE INVENTION

The present invention is directed to a flat steam chamber for use in a hosiery processing apparatus wherein steam is applied at high pressure to hosiery being carried on forms. The steam chamber includes a first wall member and a movable second wall member. The first and second wall members have facing major surfaces defining opposing major walls of the chamber and perimeter seals surrounding the major surfaces and defining minor walls of the chamber. Each major wall has a substantially greater area than each minor wall so that the chamber has a substantially flat configuration. An actuating mechanism opens and closes the steam chamber to permit hosiery carrying forms to pass through the chamber. A source of pressurized steam applies pressurized steam to the chamber in the range of approximately 18 psi to 30 psi. The major surfaces of the wall members are reinforced to prevent buckling of the major surfaces during the application of the pressurized steam to the chamber.

In a preferred embodiment, the major surfaces of the wall members are formed of relatively thin metal sheets, and the reinforcement of the metal sheets is comprised of a grid work of metal bars in contact with the outer surface of each thin metal sheet. The movable wall member is suspended from support beams in a substantially vertical position and a reciprocating drive mechanism reciprocates the movable wall member toward and away from the stationary wall member between open and closed positions of the steam chamber.

A latch mechanism selectively holds the second wall member in the closed position during the application of steam to the chamber. The latch mechanism preferably includes latching bars located along the upper and lower ends of the steam chamber.

The steam inlet is preferably located adjacent a lower end of the stationary wall member, and the steam outlet adjacent its upper end. A plurality of flow diverters are located adjacent the steam inlet to divide the steam entering the steam chamber into a plurality of flow paths.

The present invention is also directed to a unique drive mechanism and a hosiery processing apparatus incorporating the flat steam chamber and drive mechanism. In the drive mechanism, a section of drive chain, which carries the hosiery supporting forms, is held stationary within the steam chamber during the steaming process, while the remaining portion of the drive chain is continuously driven. This is accomplished by training the drive chain about sprocket on either side of the steam chamber, and supporting the sprockets on a reciprocating carriage. The carriage is driven in a rapid advance fashion when the steam chamber is opened to quickly move the processed forms out of the chamber and advance new forms into the chamber. Once the steam chamber is closed, the reciprocating drive of the carriage is disengaged and the driving motion of the drive chain moves the pulleys and carriages in a reverse direction.

The present invention is also directed to a method of processing articles of apparel which are made of synthetic fibers, in particular hosiery, utilizing a high pressure, low-volume steam chamber. The method is directed to the setting of the synthetic fibers of the article and includes the steps of: (a) placing the article on a substantially flat form; (b) moving the form and article to a low-volume flat steam chamber; (c) purging substantially all of the air from the steam chamber by injecting steam under pressure into the steam chamber; (d) setting the fibers of the article within a time period less than six seconds after steam begins to be injected into the steam chamber by holding the article in the steam environment within the steam chamber; (e) exhausting the steam from the steam chamber; and (f) removing the form and article from the steam chamber.

In a preferred embodiment of the method, the purging of the air occurs in less than one second. The steam is injected into the steam chamber at a line pressure greater than 50 psi and the holding of the article in the steam environment occurs at a pressure between 20 and 30 psi. By injecting the steam at the high line pressure, purging of the air in the low volume chamber occurs rapidly. Steps (c) through (e) are preferably performed in less than ten seconds.

The flat steam processing chamber, drive mechanism and method of the present invention allows the steam chamber to be incorporated into a conventional continuous drive, hosiery processing apparatus, which includes conventional loading, drying, stripping and packaging stations. The present invention also allows the steam processing, i.e., setting of the synthetic fiber, to occur in a rapid manner; for example, within one to seven seconds. The steam processing chamber occupies a volume only slightly greater than the volume of the hosiery carrying forms themselves.

As mentioned above, the apparatus and method of the present invention allows the reduction of set time for the synthetic fibers of the hosiery into the range of one to seven seconds, and preferably less than two seconds. Heretofore, twenty seconds was considered a fast set time for the synthetic fibers. It is believed that this reduction in set time occurs because the steam chamber of the present invention attains a more perfect steam atmosphere than the larger steam chambers of the prior art. In the large steam chambers, turbulence and mixing of the air and steam occurs so that it is difficult to rapidly attain a substantially pure steam atmosphere. In contrast, the present invention purges substantially all of the air extremely rapidly, leaving a near-perfect steam atmosphere within the chamber. It is believed that this pure steam atmosphere allows the synthetic fibers to set rapidly.

The utilization of the low-volume steam chamber in combination with the rapid advancing drive mechanism permits the steam chamber to be incorporated into a conventional hosiery processing line wherein a single operator can apply hosiery to approximately sixteen forms per minute as the forms are conveyed on a continuously driven chain. The present invention thus attains synthetic fiber setting at relatively low capital investment and labor costs. While other processing apparatuses can attain similar overall processing speeds, such apparatus are much larger than the present flat steam chamber, and hence, more expensive. Such larger apparatus also require more than a single operator.

Various advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described a preferred embodiment of the invention.

DETAILED DESCRIPTION OF THE INVENTION

Figure 1:
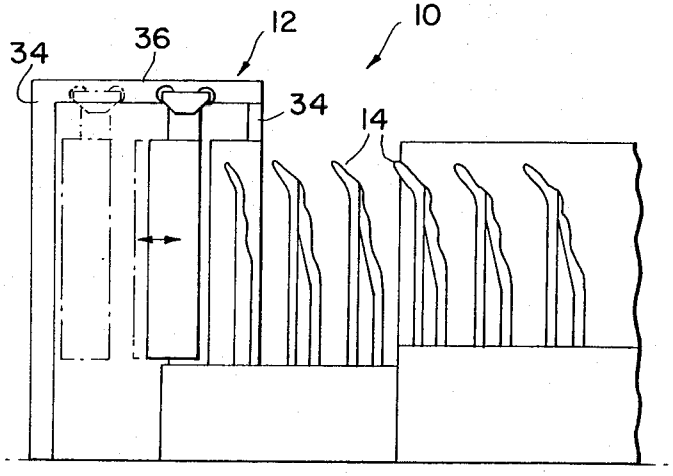
FIG. 1 is a diagramatic side elevational view of hosiery carrying forms proceeding toward a flat steam chamber in accordance with the present invention.
Figure 2:
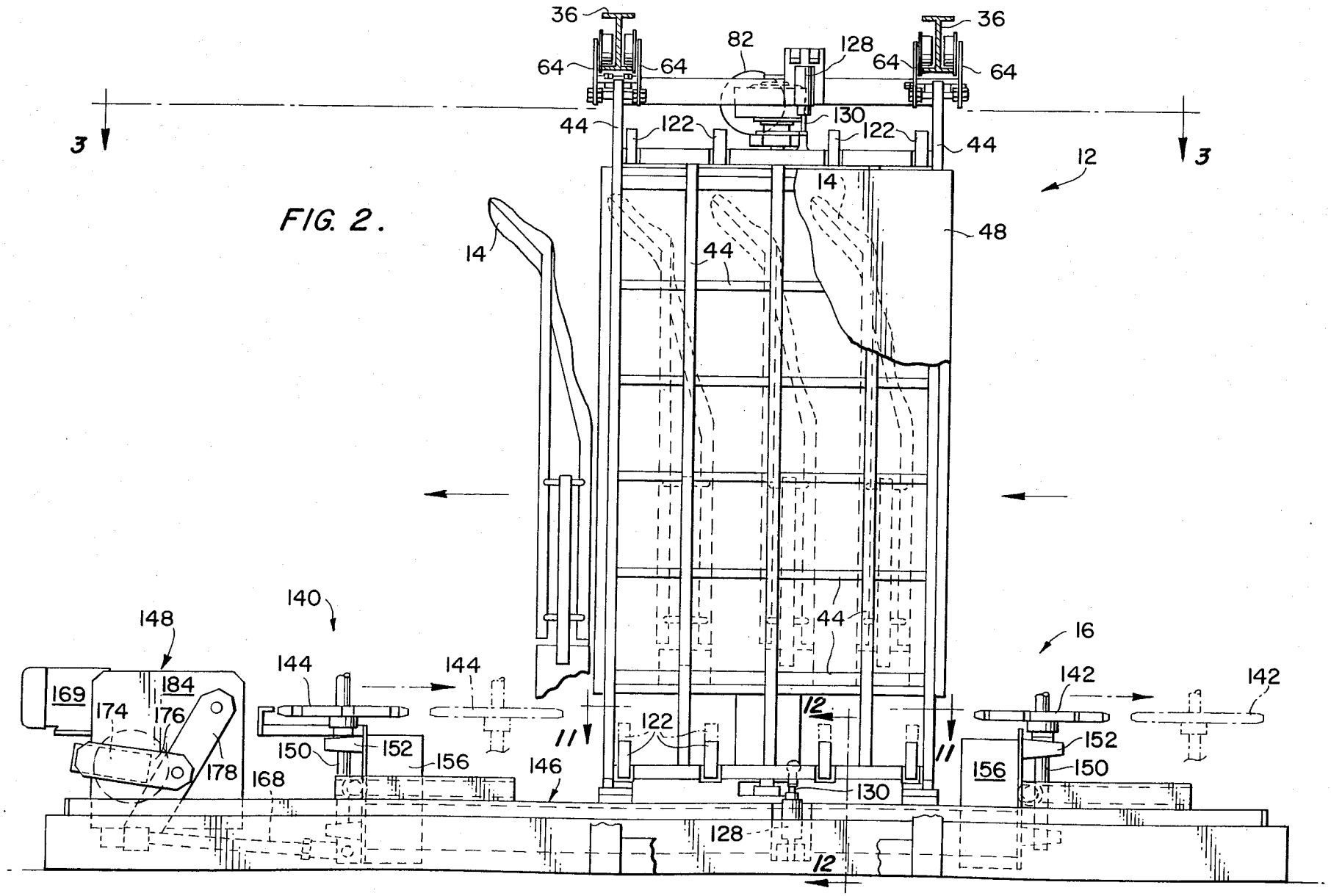
FIG. 2 is a front elevational view, partially broken away, of a steam chamber and drive mechanism in accordance with the present invention.
Figure 3:
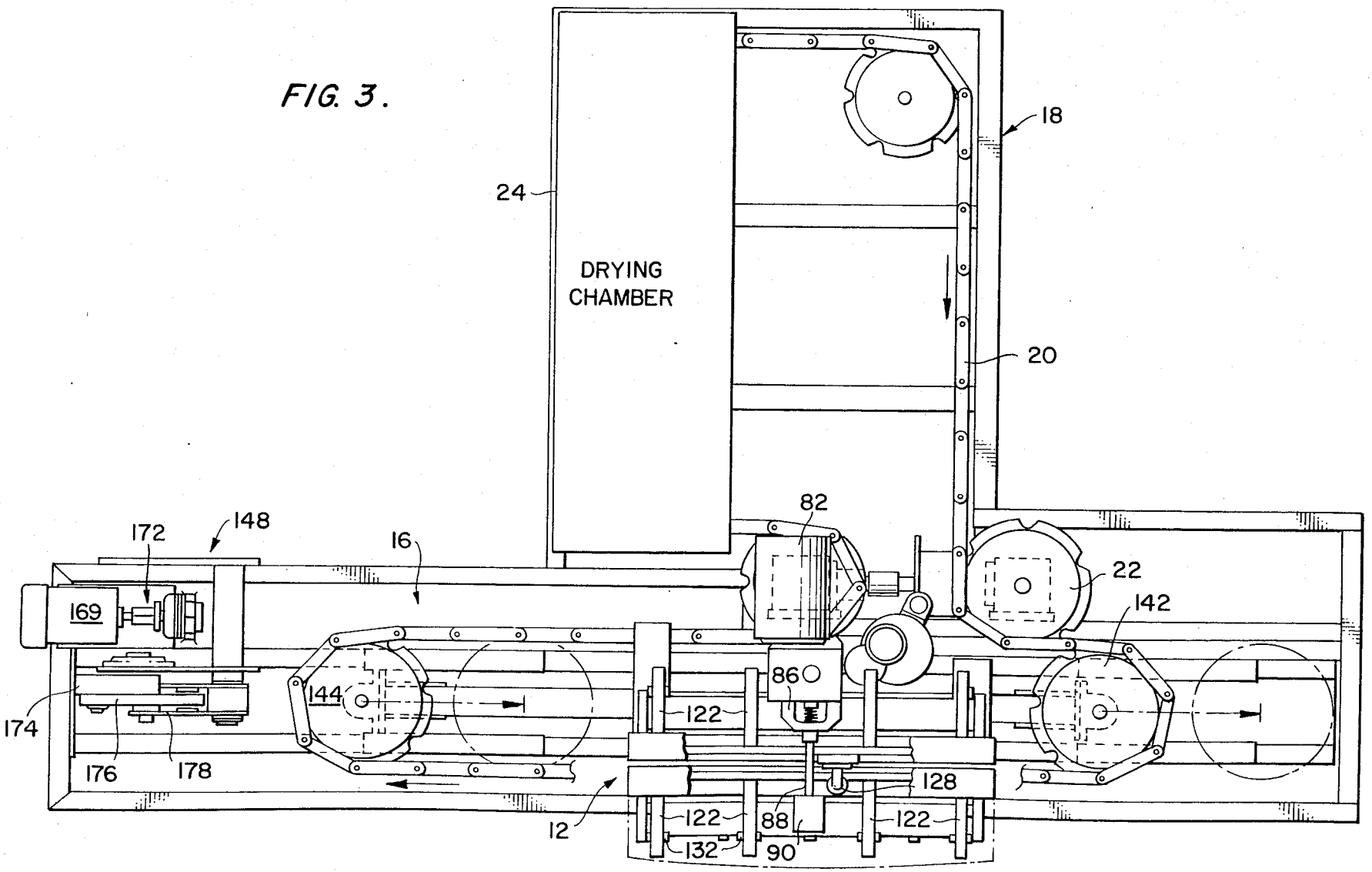
FIG. 3 is a top plan view taken generally along line 3—3 of FIG. 2.
Figure 5:
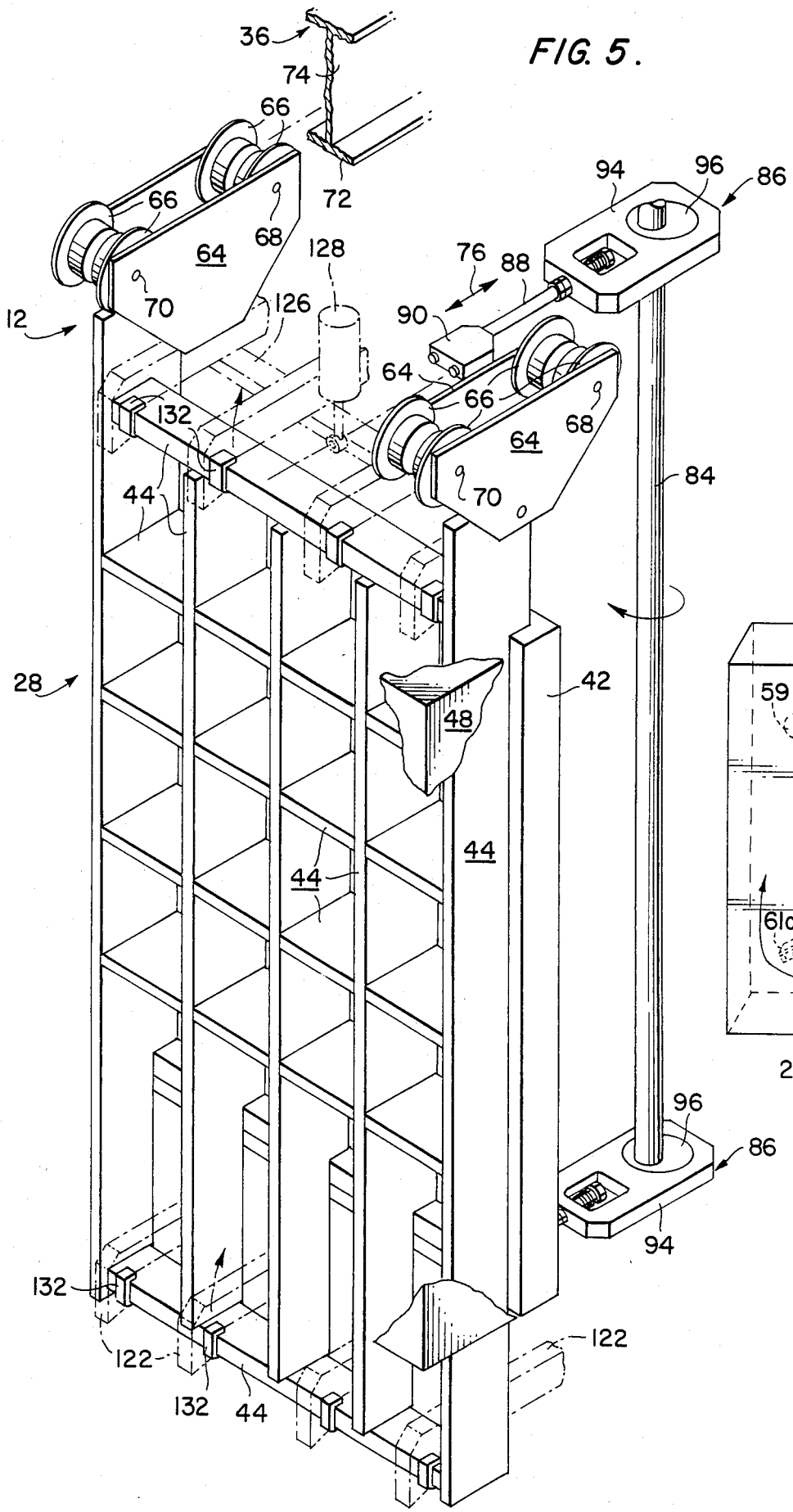
FIG. 5 is a perspective view, partially broken away, of the steam chamber.

Referring to the drawings in detail wherein like numerals indicate like elements, there is illustrated in FIG. 1 a hosiery processing apparatus 10, including a flat, high-pressure steam chamber in accordance with the present invention, designated generally as 12. A plurality of hosiery-carrying forms 14 are movably carried on a drive mechanism in accordance with the present invention, designated generally as 16, as seen in FIGS. 2 and 3.

Hosiery processing apparatus 10 includes a support frame 18 for supporting its various elements. Drive mechanism 16 includes an endless chain 20 driven by a chain drive motor 22. Forms 14 are carried by endless chain 20 through a plurality of processing stations, such as a loading station wherein hosiery is placed on each form, a steam processing station at steam chamber 12, a drying station in a drying chamber 24, and past a stripping station (not shown) wherein the processed hosiery is removed from the forms and thereafter packaged.

Steam chamber 12 includes a first wall member 26 and a second wall member 28. Wall members 26 and 28 are movable relative to one another, i.e., one or both wall members are movable, to open and close steam chamber 12. In a preferred embodiment, one of the wall members, first wall member 26, is held stationary, and the other wall member, second wall member 28, is movable. A framework 30 is formed as a portion of support frame 18 for supporting wall members 26 and 28. Framework 30 includes lower beams 32, uprights 34, and a pair of upper support I-beams 36. Framework 30 supports wall member 26 in a stationary vertical position and wall member 28 in a vertical suspended position, movable in a horizontal direction.

Figure 4:
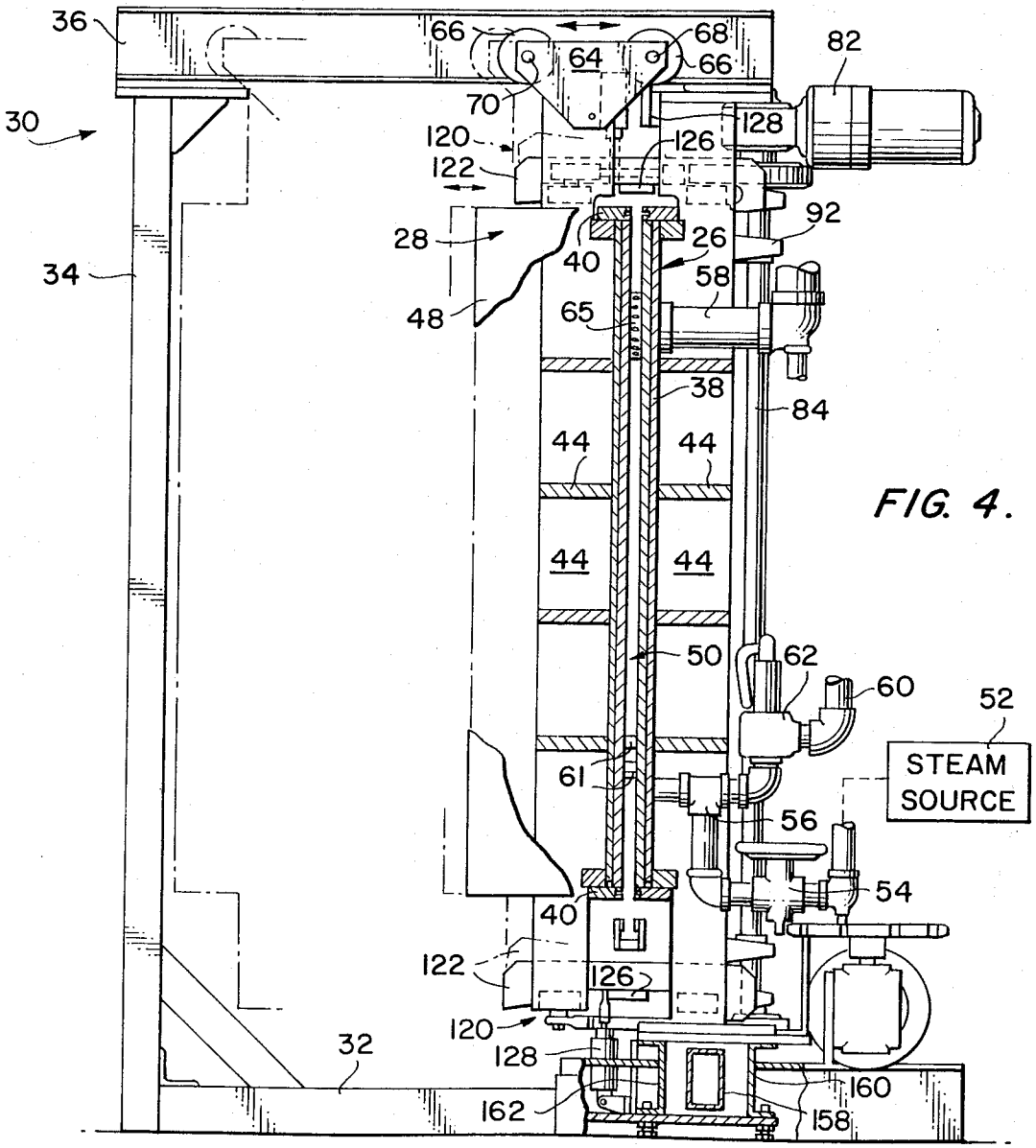
FIG. 4 is a side elevational view of the steam chamber, partially broken away and partially in section.

Each wall member 26, 28 includes a plate 38, peripheral seals 40, 42 and reinforcement bars 44. A thermally insulating layer of material 46 is preferably attached to the interior surface of each plate 38 and a cover 48 is preferably attached to the exterior surface of movable wall member 28. Plates 38 are preferably formed of a thin sheet of metal and bars 44 are formed of thicker metal. Bars 44 are secured to the exterior surface of plates 38 with their thinest edges in contact with plates 38. Bars 44 are arranged in a grid pattern to reinforce the plates 38 against buckling when high-pressure steam is applied to the interior of the chamber defined between the wall members. When movable wall member 28 is moved to a chamber closed position (to the right in FIG. 4) peripheral seals 40, 42 are placed in contact with one another, and an operative steam chamber 50 is defined between the interior surface of plates 38 and the interior surface of seals 40, 42. As seen in FIGS. 2 and 4, plates 38 define major surfaces of the chamber 50, while the seals 40, 42 define minor surfaces or walls of chamber 50. The major surface of chamber 50, as defined by plates 38, is substantially greater than any of the walls or minor surfaces defined by seals 40, 42. In fact, the width of chamber 50 is only slightly greater than the thickness of forms 14, for example, approximately one inch, while its height is approximately the same as the height of a form 14 and its length is greater than at least two forms 14, and can be long enough to accommodate three forms, as seen in FIG. 2. A chamber length to accommodate two forms has been found particularly suited for processing hosiery with a single operator in a typical processing apparatus. Chamber 50 thus takes on a substantially flat configuration. The internal volume of chamber 50 is kept low, preferably below two cubic feet; for example, in a chamber designed to accommodate two double leg (pantyhose) forms the chamber has a volume of approximately 0.87 cubic feet.

High-pressure steam, above 50 psi and preferably in the range of 60 psi to 80 psi is provided to chamber 50 from a source 52 by means of inlet valve 54, inlet conduit 56 and inlet 57 in stationary wall member 38. Inlet conduit 57 is located adjacent to a lower end of stationary wall member 38. An outlet conduit 58 is connected to an outlet 59 in stationary wall member 26 adjacent its upper end for exhausting air during the injection of steam, and for releasing steam once processing has been completed. However, the level to which pressure inside chamber 50 builds up is limited to a preselected level preferably in the range between 18 and 30 psi by a safety exhaust value 62. A pressure level of 28 psi has been found particularly suitable in processing pantyhose. A bypass conduit 60 is connected to inlet conduit 56 through a safety valve 62 to bleed off steam at excessive pressures. Feeding steam into the low volume chamber 50 at the high pressure purges the ambient air from the chamber very rapidly, i.e., in less than a second and as fast as between 0.2 to 0.5 of a second.

Figure 6:
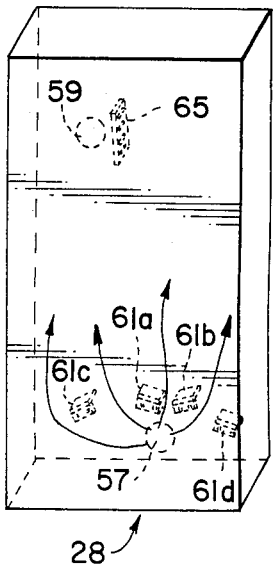
FIG. 6 is a simplified perspective view of one wall member of the steam chamber.

As is best seen in FIG. 6, inlet 57 is located at the lower end of stationary wall member 38, slightly downstream of its center; and outlet 59 is formed in stationary wall member 38 adjacent its upper end and at a location which is slightly upstream of its center. A plurality of diverter plates 61*a*–61*d* are located about inlet 57. Diverter plates 61 are attached to the interior surface of movable wall member 28 and have a width such that their free ends contact the interior surface of the stationary wall member 38 when the steam chamber is in its closed position. Diverter plates 61 divide the flow of steam entering chamber 50 into a plurality of upwardly directed flow paths as illustrated by arrows 63. A more even laminar flow across the entire width of chamber 50 is thus attained. A slotted baffle 65 is attached to the interior surface of movable wall member 28 and has a width such that its free end contacts the interior surface of the stationary wall member 38 when the steam chamber is in its closed position. Slotted baffle 65 is located adjacent outlet 59 and functions to reduce the flow of steam across the hosiery positioned nearest the exhaust outlet 59.

A pair of support brackets 64 are connected to the upper end of each sidemost, vertically extending reinforcement bar 44. Each pair of brackets 64, in turn, rotatably supports four rollers 66. A first pair of rollers 66 is supported about a common forward axis 68, and a second pair of rollers 66 is supported about a common second axis 70, on each respective pair of brackets 64. Rollers 66 are carried for rolling motion on the lower horizontal surface 72 on either side of the vertical surface 74 of each I-beam 36. Rollers 66 thus support movable wall member 28 in a vertically suspended position for reciprocal horizontal motion in the direction indicated by arrows 76.

An eccentric drive mechanism 80, illustrated in detail in FIGS. 4, 5, 12 and 13, is connected to movable wall member 28 to reciprocate it in direction 76 between an open position wherein the wall members are out of contact with one another and forms 14 are free to move, and a closed position wherein peripheral seals 40, 42 are in contact with one another and in contact with the lower end of forms 14 to define the sealed operative steam chamber 50. Eccentric drive mechanism 80 includes a rotary drive motor 82 for rotating a drive shaft 84, a pair of eccentric assemblies 86 coupled to drive shaft 84 at horizontally spaced positions for converting rotary motion of drive shaft 84 into reciprocating motion generally in direction 76, a connecting shaft 88 connected to each eccentric assembly 86, and a coupling assembly 90 connecting each connecting shaft 88 to movable wall member 28.

Drive motor 82 is supported at the upper end of framework 30. Drive shaft 84 extends about a generally vertical axis and is drivingly coupled to motor 82. Shaft 84 extends downward to the lower end of framework 30 and is rotatably journaled in bearings 92 located adjacent the upper and lower ends of shaft 84. The manner in which drive shaft 84 is coupled to movable wall member 28 through assemblies 86, 90 and connecting shaft 88 is the same for each associated pair of assemblies 86, 90; hence, the following description is applicable to the coupling of shaft 84 to wall member 28 at both the upper and lower ends of wall member 28. Eccentric assembly 86 includes an eccentric housing 94 which rotatably supports an eccentric hub 96. Drive shaft 84 is keyed to eccentric hub 96 at a location eccentric to the center of hub 96 by a key 98. The rotation of hub 96 within housing 94 will cause housing 94 to reciprocate in the general direction 76. However, since shaft 84 is journaled about a stationary vertical axis, housing 94 will wobble in a small arch that is indicated by curved arrows 100.

Connecting shaft 88 extends through a bore 102 in eccentric housing 94, and is held therein between nuts 104, 106, a spacer 108, and a spring 110. Nuts 104, 106 can be adjusted so that spring 110 is placed under a slight amount of compression when wall member 28 is moved to the chamber closed position. The other end of connecting shaft 88 is fitted into a threaded bore 112 in coupling assembly 90 and held therein by a nut 114. Coupling assembly 90 is connected to an uppermost horizontal reinforcement bar 44 through a connecting stud 116 carried within a bushing 118 of coupling assembly 90. Wobble in direction 100 is thus absorbed by rotation of coupling assembly 90 about stud 116 so that movable wall member 28 can move in the linear direction 76. A clutch is coupled to drive motor 82 so that shaft 84 is rotated in 180° cycles to reciprocate wall member 28 between the chamber open and closed positions.

Figure 10:
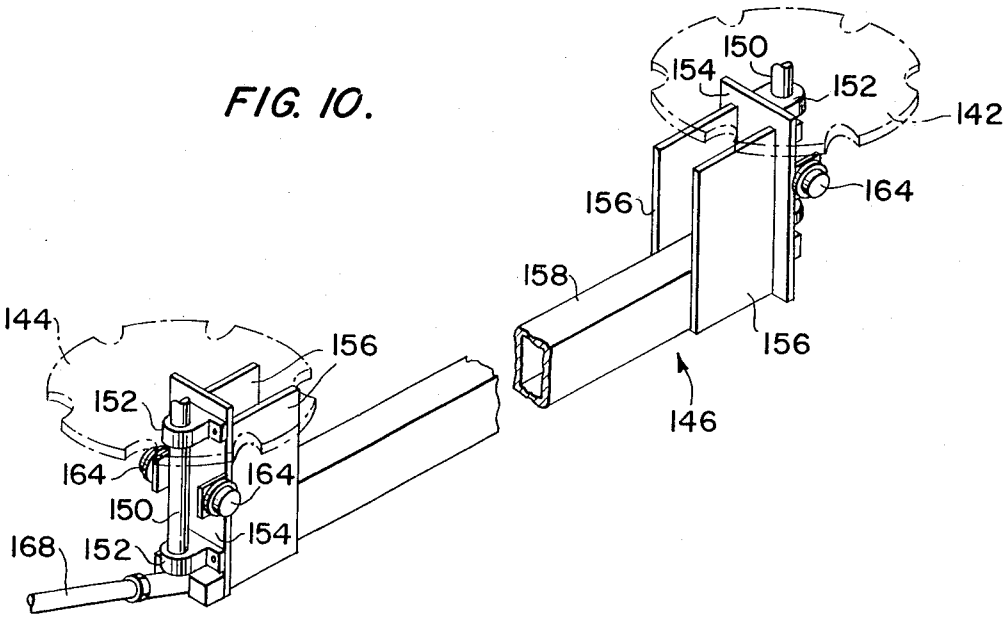
FIG. 10 is a perspective view of the sprocket-carrying portion of the reciprocating carriage.
Figure 11:
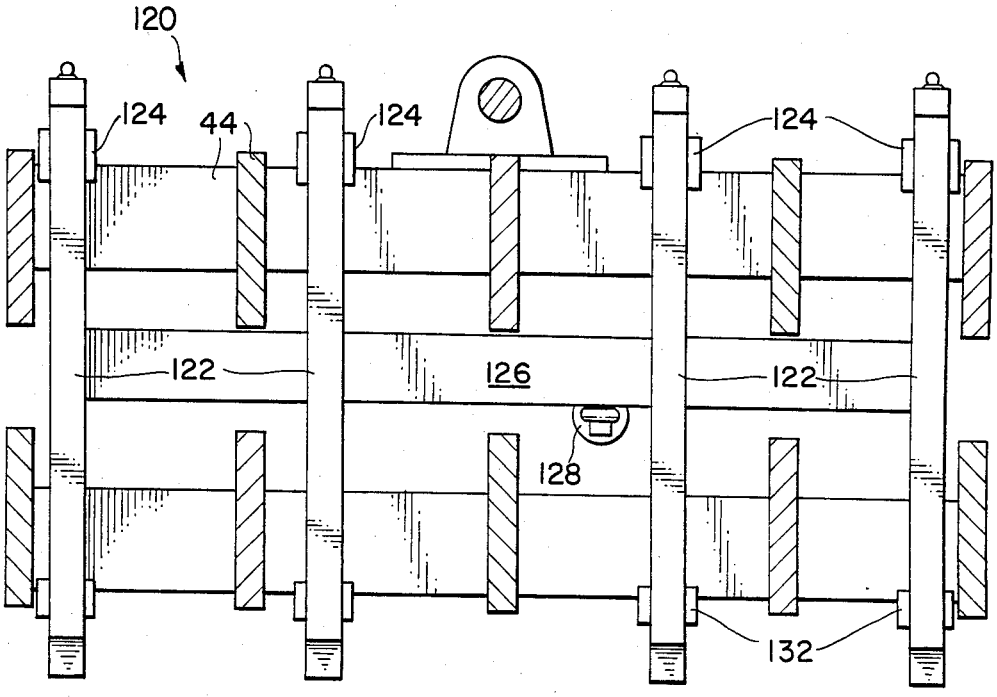
FIG. 11 is a cross-sectional view taken generally along line 11—11 of FIG. 2, illustrating the latching mechanism.
Figure 12:
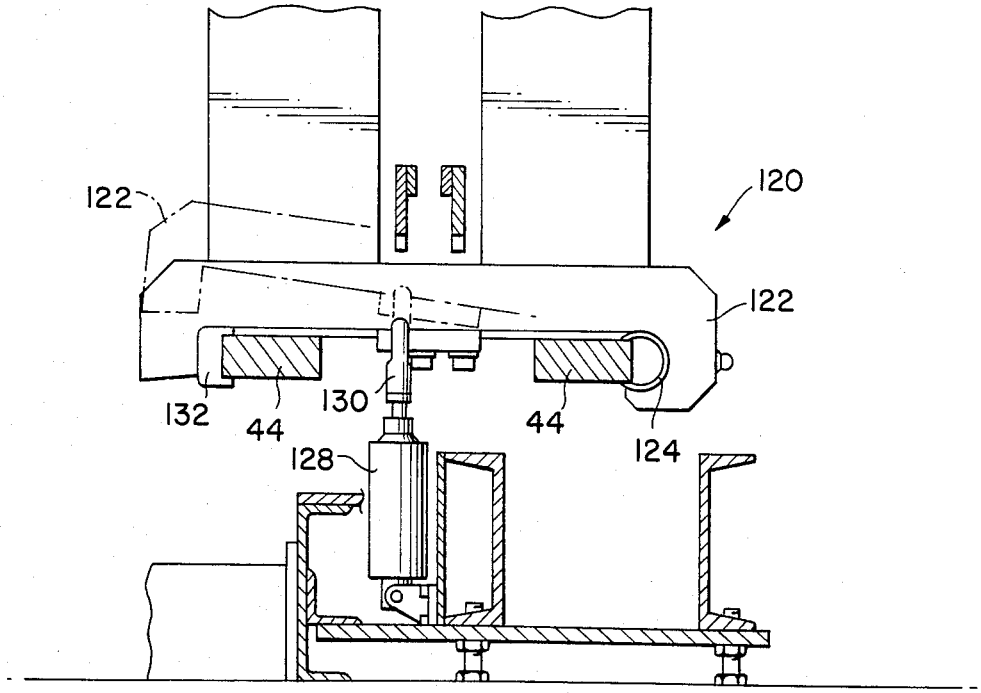
FIG. 12 is a cross-sectional view taken generally along line 12—12 of FIG. 2.
Figure 13:
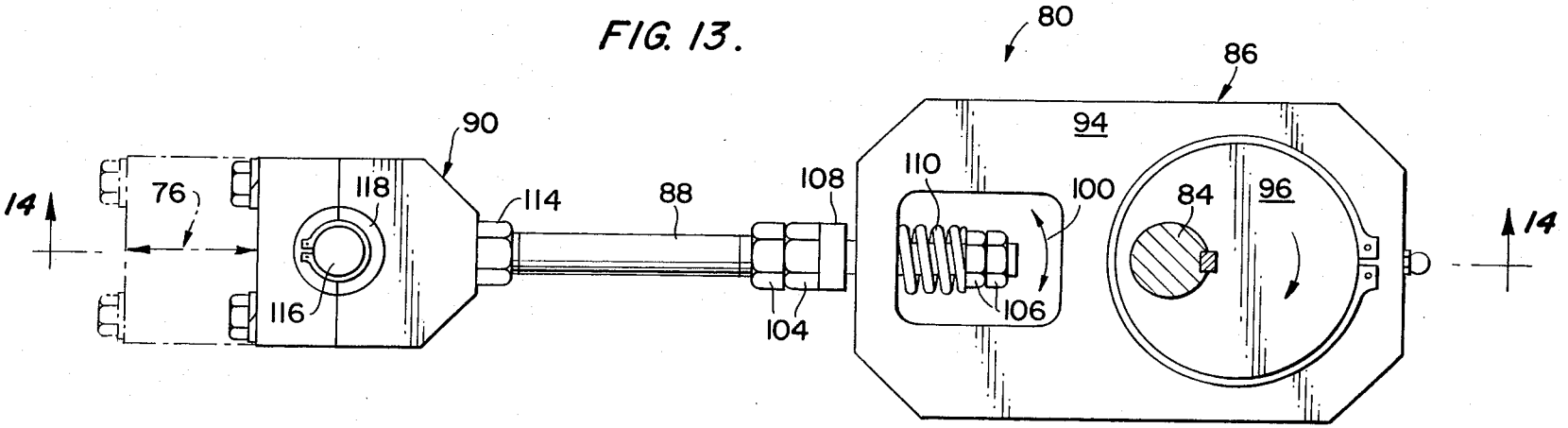
FIG. 13 is a plan view of an eccentric drive mechanism for opening and closing the steam chamber.
Figure 14:
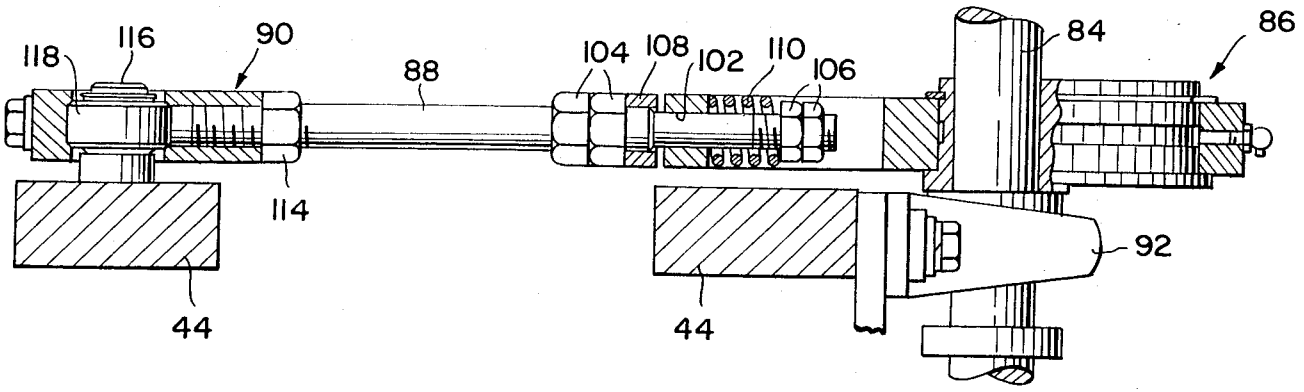
FIG. 14 is a sectional view taken generally along line 14—14 of FIG. 13.

Upper and lower latch mechanisms 120 are connected between uppermost and lowermost horizontal reinforcement bars 44 of the stationary and movable wall members 26, 28. These uppermost and lowermost bars 44 are respectively located above and below the ends of plates 38. Since both upper and lowermost latch mechanisms are substantially the same, only lowermost latch mechanism 120, which is shown in detail in FIGS. 10 and 11, will be discussed. Latch mechanisms 120 serve to hold operative steam chamber 50 closed during the application of high pressure steam. In small chambers; for example, one or two form chambers, this latching function may be performed by the linkage of the movable wall member drive system.

Latch mechanism 120 includes a plurality of latch bars 122 pivotably connected to a lowermost horizontal reinforcement bar 44 of fixed wall member 26 by cylindrical pivot blocks 124. The individual latch bars 122 are connected to one another by a tie bar 126 for motion as a unit. Tie bar 126 is located along the juncture between wall members 26, 28. An air cylinder 128 is pivotably connected to a lower portion of framework 30, and includes a movable rod 130 connected to tie bar 126. Extending and retracting motion of rod 130 pivots latch bars 122 between the full line and phantom line positions illustrated in FIG. 11. In the full line, down position, latch bars 122 are received about latch blocks 132 which are connected to the lowermost horizontal reinforcing bar 44 of movable wall member 28. In this latched position chamber 50 is secured in its closed position. When the latch bars 122 are raised to their phantom line unlatched positions, wall member 28 is free to move to the open chamber position. Uppermost latch mechanism 120 operates in a similar manner, except that air cylinder 128 is pivotably suspended from an upper cross bar of framework 30, and latch bars 122 are coupled to the uppermost reinforcement bars 44.

Drive mechanism 16, as illustrated in FIGS. 2, 3 and 6–9, includes a rapid advance mechanism, designated generally as 140, which performs the function of holding a section of chain 20 stationary within operative steam chamber 50 while permitting the remainder of chain 20 to be continuously advanced, and thereafter rapidly advancing the section of chain 20, which had been held stationary so that the hosiery which had been processed in operative chamber 50 is advanced out of the chamber and new hosiery on forms 14 are placed into the chamber for processing.

Figure 9:
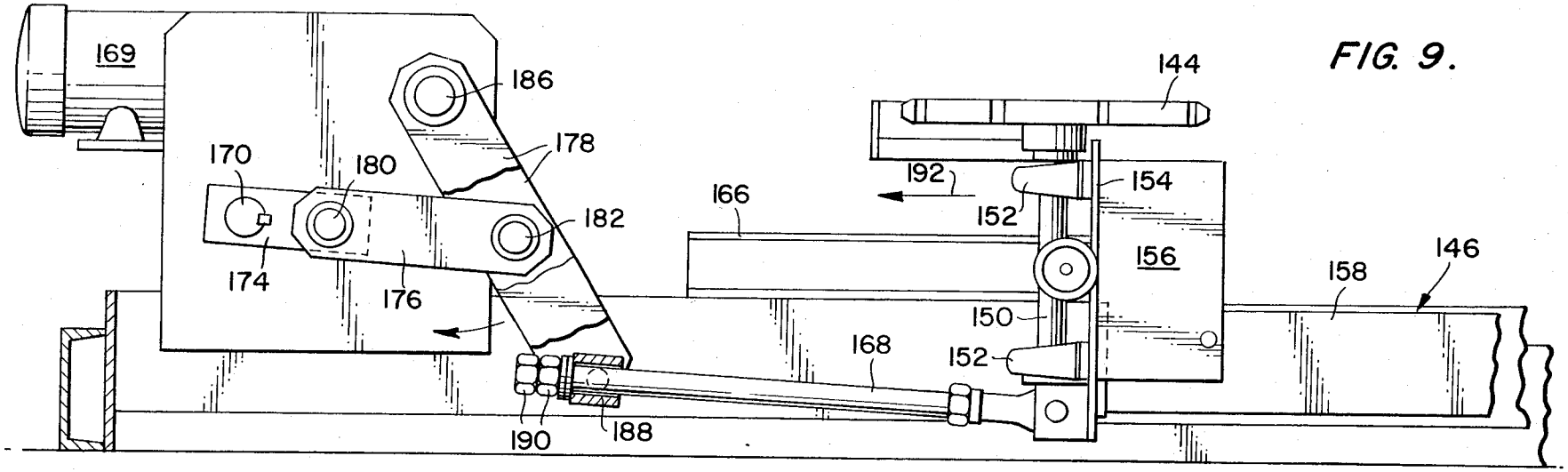
FIG. 9 is a side elevational view of the drive mechanism for the reciprocating carriage.

Mechanism 140 includes a pair of sprockets 140, 142, a reciprocating carriage assembly 146, and a crank drive mechanism 148. Sprocket 142 is rotatably carried by carriage assembly 146 on an upstream side of steam chamber 12, and sprocket 144 is rotatably carried by carriage assembly 146 on a downstream side of steam chamber 12. Endless chain 20 is trained about sprockets 142 and 144, and passes below operative chamber 50. Sprockets 142, 144 are reciprocable between the full line and phantom positions shown in FIG. 2, in a manner more fully discussed hereinafter. Each sprocket 142 and 144 is connected to carriage assembly 146 in a similar manner and, hence, only the coupling of sprocket 144 will be discussed in detail. Sprocket 144 is connected to the upper end of a support rod 150. Support rod 150 is supported for rotary motion about a generally vertical axis by a pair of vertically spaced bearings 152 which are connected to a transverse plate 154. Transverse plate 154 in turn is attached to lateral edges of transversely spaced plates 156. Each plate 156 is connected to an opposite transverse side of a connecting beam 158 which extends between and connects with the support structure for pulley 142 (FIG. 9).

Connecting beam 158 and pulleys 144, 142 are carried for reciprocating motion by transversely spaced beams 160, 162 (FIG. 4) between which connecting beam 158 extends. Rollers 164 are rotatably carried on each transverse plate 154 and are rotatably received within channels 166 attached to the top of beams 160, 162.

A guide rod 168 is pivotably connected to transverse plate 154 on the downstream side of steam chamber 12 and connects carriage assembly 146 to the remainder of crank drive mechanism 148. Crank drive mechanism 148 also includes: a drive motor 169 which is connected to a rotatable crank shaft 170 though a conventional clutch and transmission mechanism 172; a crank arm 174 connected to crank shaft 170; a connecting arm 176 connected between crank arm 174 and a lever arm 178 which is coupled to guide rod 168.

Crank shaft 170 is rotated by drive motor 169 through the clutch and transmission mechanism 172. Crank arm 174 is keyed to shaft 170 so that it is rotated by rotation of the shaft. One end of connecting arm 176 is connected to crank arm 174 by a pin 180 at a location along crank arm 174 which is spaced from the axis of crank shaft 170. opposite end of connecting arm 176 is connected to lever arm 178 by a pin 182 at a location adjacent its center in a longitudinal direction. An upper end of lever arm 178 is pivotably connected to a crank drive housing 184 by a pin 186. The lower end of lever end 178 is slidingly coupled to guide rod 168 by a cylindrical bushing 188. Nuts 190 are attached to the distal end of guide rod 168.

Figure 8:
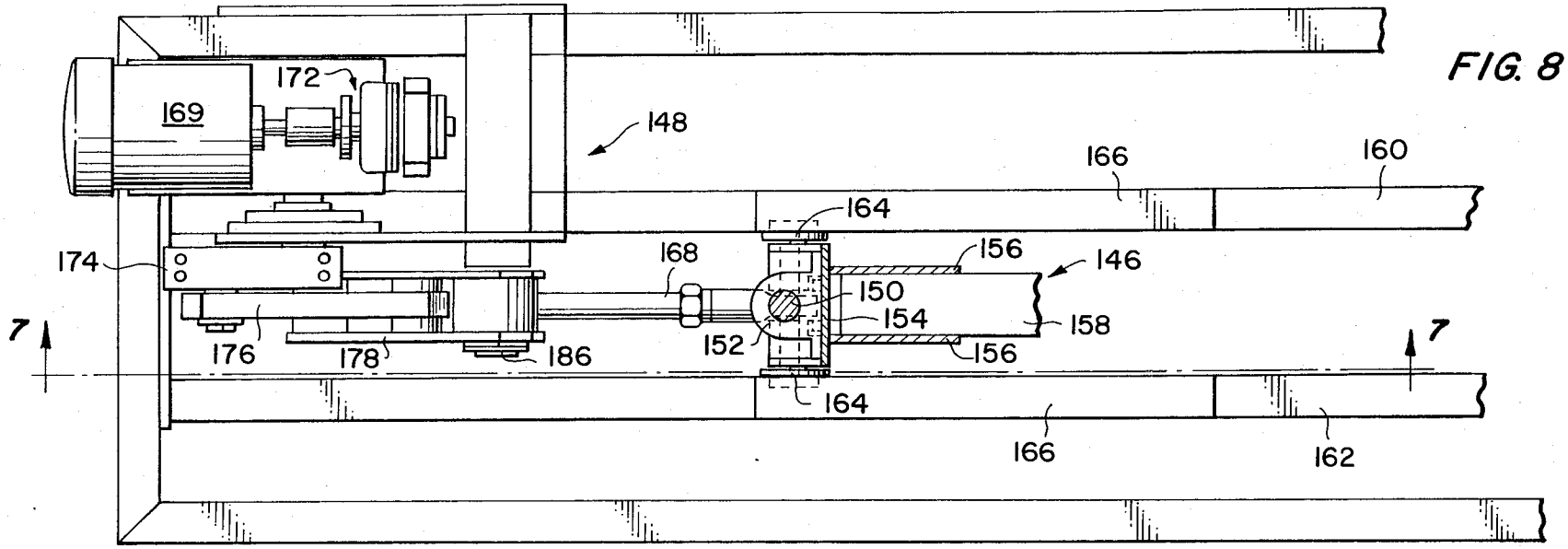
FIG. 8 is a plan view taken generally along lines 8—8 of FIG. 7.
Figure 7:
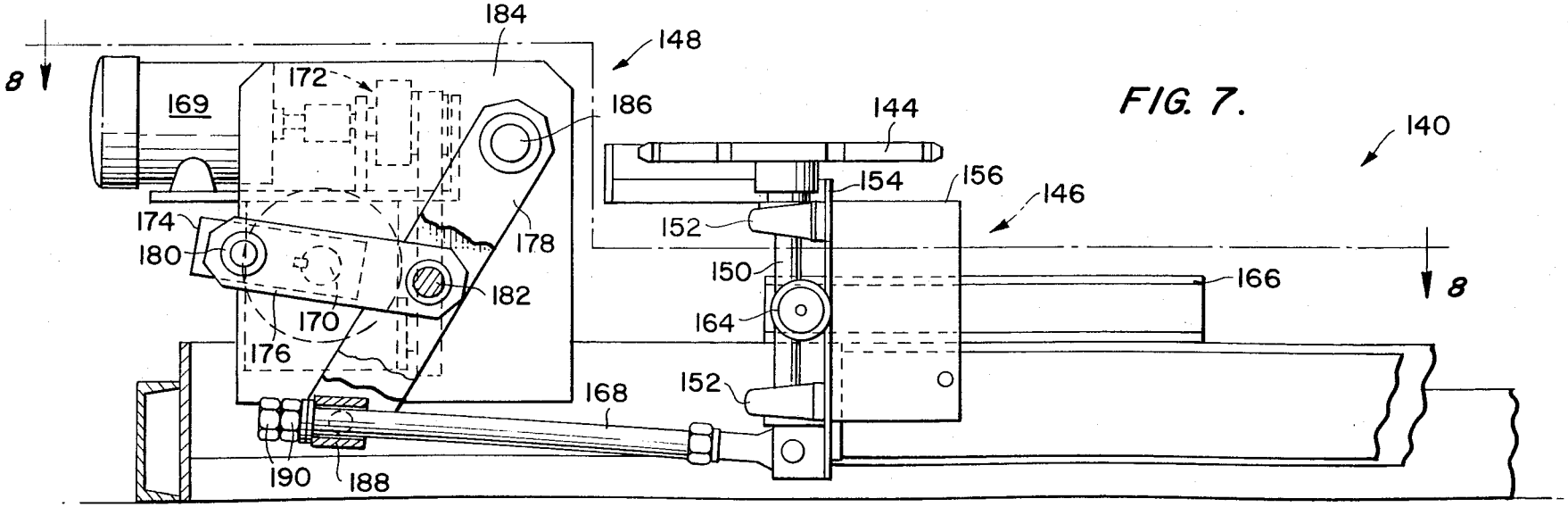
FIG. 7 is a front elevational view of the drive mechanism for the reciprocating carriage, taken generally along line 7—7 of FIG. 8.

The rotation of crank arm 174 by crank shaft 170 causes connecting arm 176 to pull and push lever arm 178 between the extreme positions shown in FIGS. 6 and 8. In the position shown in FIG. 8, carriage 146 is in its rightmost position. In the rightmost position, processing in steam chamber 12 has been completed and the chamber is opened by unlatching latch mechanism 120 and moving wall member 28 away from wall member 26. Clutch mechanism 172 couples drive motor 169 to crank shaft 170 which then rotates crank arm 174 to pull lever arm 178 to the left.

Bushing 188 abuts against nuts 190 and pulls carriage assembly 146 to the left as shown by arrow 192 in FIG. 8. Motion to the left continues until lever arm 178 reaches its furthest left position as shown in FIG. 6. After this position is reached, clutch 172 keeps crank shaft 170 coupled to drive motor 179 so that lever arm 178 then proceeds to the right by having bushing 188 slide along guide rod 168. When lever arm 178 reaches its left most position, clutch 172 disengages crank shaft 170 from drive motor 169. As carriage 146 is being advanced to the left, the hosiery which had been processed in steam chamber 12 is rapidly advanced to the left, out of steam chamber 12, and a number of forms carrying hosiery to be processed is rapidly advanced into steam chamber 12. With the new set of forms in steam chamber 12, movable wall member 28 is moved to the chamber closed position whereby seals 40, 42 of facing wall members 26, 28 come into contact to define operative chamber 50 and to thereby hold the forms and hosiery stationary within the operative steaming chamber 50.

Since the continued rotation of crank shaft 170 has moved lever arm to its rightmost position, with guide rod 168 and carriage assembly 146 in the leftmost position, bushing 188 is placed out of engagement with nuts 190. This frees carriage assembly 146 so that continued drive of the remaining portion of endless chain 20 (a section of the chain is held stationary in the closed steam chamber 12) pulls carriage assembly 146 through its engagement with pulleys 142, 144 to the right until the rightmost position, shown in phantom line in the figures, is reached, and a new cycle is begun.

Articles of apparel made of synthetic fibers, in particular hosiery are processed in accordance with the present invention, which utilizes a low-volume flat steam chamber, such as disclosed hereinabove. The method includes the steps of placing the article on a substantially flat form, and thereafter moving the form and article held thereon to a flat steam chamber. A relative low number of articles are processed in the steam chamber during a single cycle, for example, 2 or 3 articles. Utilizing the above apparatus, the articles are carried on a continuously driven chain, a portion of which is held stationary at the steam chamber during processing therein, and thereafter rapidly advanced. The movable wall member opens and closes the steam chamber to allow forms to enter and leave the chamber. When the movable wall member is in its closed position, the periphery of the steam chamber is sealed to define a low-volume internal operative chamber, preferably with a volume less than 2.0 cubic feet, and as low as 0.87 cubic feet. Once the operative chamber has been sealed, substantially all of the ambient air is purged from the operative chamber in less than a second and the fibers of the article are set in less than five seconds after substantially all of the ambient air has been purged of the operative chamber. Setting of the fibers thus is accomplished in less six seconds after steam begins to be injected into the operative chamber.

The purging of the air and the setting of the fibers is accomplished by injecting the steam into the operative chamber at a line pressure above 50 psi, preferably in the range of approximately 60 to 80 psi; thereafter stopping the injection of the steam into the operative chamber when the pressure therein reaches the range of 18 to 30 psi, preferably at 28 psi; and holding the steam in the operative chamber until the fibers of the article are set. In some applications, the purging of the air from the chamber need not be performed so rapidly. The steam thus can be applied to the chamber at a reduced pressure, i.e., at a level approximately equal to or slightly above the desired pressure level at which setting will take place. The line pressure, in such applications, can therefore be reduced to between 18 and 30 psi prior to the point where the steam reaches the chamber.

The steam in the chamber is thereafter exhausted through an exhaust conduit, typically occurring in one to two seconds; and the steam chamber is thereafter opened by moving the movable wall member away from the stationary wall member. The steps of sealing the chamber, purging of the air, setting of the fibers, exhausting of the steam, and opening of the steam chamber are performed in less than ten seconds, and as fast as 4.0 seconds.

Once the chamber is opened the advancing mechanism advances the portion of the chain which has been held stationary rapidly forward to move the processed articles out of the steam chamber and to insert new forms with articles to be processed inside the chamber. The advancing mechanism moves the section of the drive chain, which had been held stationary, at a speed faster than the speed of continuous drive of the drive chain. The movable wall member then reciprocates back against the stationary wall member to begin the process anew.

Numerous characteristics and advantages of the invention have been set forth in the foregoing description, together with details of the structure and function of the invention, and the novel features thereof are pointed out in the appended claims. The disclosures, however, is illustrative only, and changes may be made in detail, especially in matters of shape, size, and arrangement of the parts, within the principal of the invention, to the full extent indicated by the broad general meaning of the terms in which the appended claims are expressed.

I claim:

1. A method of setting synthetic fibers of hosiery within a low-volume flat steam chamber comprising the steps of:

(a) placing an article of hosiery made of synthetic fiber on a substantially flat form;

(b) moving the form and article into a flat steam chamber;

(c) sealing the periphery of the steam chamber to define an internal operative chamber with a volume less than 2.0 cubic feet;

(d) purging substantially all of the ambient air from the operative chamber in less than one second and setting the fibers of the article of hosiery in less than five seconds after substantially all of the ambient air is purged from the operative chamber by:

(i) injecting steam into said operative chamber at a line pressure above 50 psi;

(ii) holding the steam in the operative chamber until the fibers of the article of hosiery are set;

(e) opening the steam chamber;

(f) removing the form and the article of hosiery from the steam chamber.

2. A method in accordance with claim 1 wherein step (d) includes diverting the steam being injected into the operative chamber into a plurality of flow paths within the operative chamber.

3. A method in accordance with claim 1 wherein steps (c) through (e) are performed in less than ten seconds.

4. A method in accordance with claim 1 wherein step (d) includes:

(i) injecting steam into the operative chamber at a line pressure between approximately 60 and 80 psi; and (ii) stopping the injection of the steam into the operative chamber when the pressure therein reaches approximately the range of 18 to 30 psi.

5. A method in accordance with claim 1 wherein steps (b) and (f) include:

(i) carrying the forms on an endless drive chain;

(ii) continuously driving the endless drive chain;

(iii) holding a section of the drive chain stationary at the steam chamber during the operation of steps (c) through (e) while the remainder of the drive chain remains continuously driven; and (iv) advancing the section of drive chain which had been held stationary at a speed greater than the speed at which the drive chain is continuously driven.

6. A method in accordance with claim 1 wherein steps (c) and (e) include:

(i) holding a first wall member of the steam chamber in a substantially vertical stationary position;
(ii) holding a second wall member of the steam chamber in a substantially vertical position, facing the first wall member and movable in a generally horizontal direction; and
(iii) reciprocating the second wall member in the generally horizontal direction between a closed chamber position in step (c) and an open chamber position in step (e).

7. A method in accordance with claim 1 including the step of exhausting steam from the operative chamber before opening the steam chamber.

8. A method of setting synthetic fibers of an article of apparel comprising the steps of:
(a) placing an article of apparel on a substantially flat form;
(b) moving the form and article into a low-volume flat steam chamber;
(c) purging substantially all of the air from the steam chamber by injecting steam under pressure into the steam chamber;
(d) setting the fibers of the article within a time period less than six seconds after steam begins to be injected into the steam chamber by holding the article in the steam environment within the steam chamber;
(e) exhausting the steam from the steam chamber;
(f) removing the form and article from the steam chamber.

9. A method in accordance with claim 8 wherein the purging of the air in step (c) occurs in less than one second.

10. A method in accordance with claim 8 wherein the injecting of the steam into the steam chamber occurs at a line pressure greater than 50 psi.

11. A method in accordance with claim 8 wherein steps (c) through (e) are performed in less than ten seconds.

12. A method in accordance with claim 8 including the step of sealing the periphery of the steam chamber to define an internal operative chamber with a volume less than two cubic feet before performing step (c).

13. A method of setting synthetic fibers of hosiery within a low-volume flat steam chamber comprising the steps of:
(a) placing an article of hosiery made of synthetic fiber on a substantially flat form;
(b) moving the form and article into a flat steam chamber;
(c) sealing the periphery of the steam chamber to define an internal operative chamber with a volume less than 2.0 cubic feet;
(d) purging substantially all of the ambient air from the operative chamber and setting the fibers of the article of hosiery in less than six seconds after the periphery of the steam chamber is sealed by:
(i) injecting steam into said operative chamber;
(ii) holding the steam in the operative chamber until the fibers of the article of hosiery are set;
(e) opening the steam chamber;
(f) removing the form and the article of hosiery from the steam chamber.

14. A method in accordance with claim 13 wherein step (d) includes diverting the steam being injected into the operative chamber into a plurality of flow paths within the operative chamber.

15. A method in accordance with claim 13 wherein steps (c) through (e) are performed in less than ten seconds.

16. A method in accordance with claim 13 wherein step (d) includes:
(i) injecting steam into the operative chamber at a line pressure above 30 psi.

17. A method in accordance with claim 13 wherein steps (b) and (f) include:
(i) carrying the forms on an endless drive chain;
(ii) continuously driving the endless drive chain;
(iii) holding a section of the drive chain stationary at the steam chamber during the operation of steps (c) through (e) while the remainder of the drive chain remains continuously driven; and
(iv) advancing the section of drive chain which had been held stationary at a speed greater than the speed at which the drive chain is continuously driven.

18. A method in accordance with claim 13 wherein steps (c) and (e) include:
(i) holding a first wall member of the steam chamber in a substantially vertical stationary position;
(ii) holding a second wall member of the steam chamber in a substantially vertical position, facing the first wall member and movable in a generally horizontal direction; and
(iii) reciprocating the second wall member in the generally horizontal direction between a closed chamber position in step (c) and an open chamber position in step (e).

19. A method in accordance with claim 13 including the step of exhausting steam from the operative chamber before opening the steam chamber.

* * * * *